United States Patent [19]

Shibata et al.

[11] Patent Number: 4,631,024

[45] Date of Patent: Dec. 23, 1986

[54] CATALYTIC COMBUSTION DEVICE

[75] Inventors: Tsuneo Shibata, Kawanishi; Yoshitaka Mohri, Minoo; Haruo Ida, Sakai; Haruo Ishikawa, Kawanishi, all of Japan

[73] Assignee: Matsushita Electric Industrial Co., Ltd., Osaka, Japan

[21] Appl. No.: 682,671

[22] PCT Filed: Apr. 16, 1984

[86] PCT No.: PCT/JP84/00192

§ 371 Date: Dec. 18, 1984

§ 102(e) Date: Dec. 18, 1984

[87] PCT Pub. No.: WO84/04377

PCT Pub. Date: Nov. 8, 1984

[30] Foreign Application Priority Data

| | | | |
|---|---|---|---|
| Apr. 20, 1983 | [JP] | Japan | 58-70360 |
| Apr. 20, 1983 | [JP] | Japan | 58-70362 |
| Apr. 22, 1983 | [JP] | Japan | 58-71667 |
| Jul. 8, 1983 | [JP] | Japan | 58-125028 |

[51] Int. Cl.[4] ..... A45D 1/04; F23Q 11/00

[52] U.S. Cl. ..... 431/268; 431/328; 431/329; 431/21; 126/409

[58] Field of Search ..... 431/268, 328, 329, 21; 126/408, 409

[56] References Cited

U.S. PATENT DOCUMENTS

| | | | |
|---|---|---|---|
| 2,999,534 | 9/1961 | Wagner | 431/268 |
| 3,199,505 | 8/1965 | Lloyd | 431/268 |
| 4,207,055 | 6/1980 | Tanaka | 431/268 |
| 4,361,133 | 11/1982 | Bonnema | 126/408 |

FOREIGN PATENT DOCUMENTS

| | | |
|---|---|---|
| 18463 | 12/1935 | Japan . |
| 50-37075 | 10/1975 | Japan . |
| 57-23854 | 5/1982 | Japan . |
| 58-12925 | 1/1983 | Japan . |

*Primary Examiner*—Carroll B. Dority, Jr.

*Attorney, Agent, or Firm*—Stevens, Davis, Miller & Mosher

[57] ABSTRACT

A catalytic combustion device of the type including a catalyst for oxidation of a fuel vapor and air, and an ignition heater for initiating oxidation on the catalyst is disclosed. The device comprises a tubular first member carrying thereon the catalyst for supplying the fuel vapor to the catalyst, and a tubular second member disposed in the first member defining therein a passageway for the fuel vapor, the second member being secured at its one end thereof to the first member so as to constitute a thermostatic element for controlling the rate of gas flow by means of the difference in thermal expansion between the first and second members.

6 Claims, 9 Drawing Figures

List of Reference Characters in the Drawings

1 ..... tank casing

2 ..... tank

3 ..... battery

4 ..... bottom cap

5 ..... gas injector valve

6 ..... injecting portion

7 ..... negative terminal

8 ..... screw

9 ..... positive terminal

10 ..... switching button

11 ..... heater terminal

12 ..... switching terminal

13 ..... battery cover

14 ..... ignition heater

15 ..... lead wire

16 ..... insulating tube

17 ..... wick

18 ..... vaporising portion

19 ..... flow control valve

20 ..... passageway

21 ..... nozzle

22 ..... closure tube

23 ..... valve

24 ..... coil spring

25 ..... O-ring

26 ..... O-ring

27 ..... coil spring

28 ..... lever

29 ..... O-ring

30 ..... first member

31 ..... second member

32 ..... air sucking portion

33 ..... temperature selector

34 ..... connector

35 ..... sealing screw

36 ..... safety member

37 ..... collar

38 ..... gas diffuser tube

39 ..... catalyst for combustion

40 ..... catalyst for ignition confirmation

41 ..... retainer

42 ..... heat transfer tube

43 ..... burner plug

44 ..... curling element

45 ..... rib

46 ..... transparent member

47 ..... window

48 ..... cap

49 ..... abutting rib

50 ..... shoulder

51 ..... aperture

52 ..... aperture

53 ..... aperture

54 ..... tank

55 ..... vaporisor

56 ..... wick

57 ..... fixed valve seat of a gas-flow control valve

58 ..... flow control valve

59 ..... nozzle

60 ..... control valve

61 ..... injector

62 ..... first member

63 ..... second member

64 ..... gas blow hole

65 ..... gas supply hole

66 ..... catalyst for combustion

67 ..... ignition heater

68 ..... fixing member

69 ..... control lever

70 ..... pivot shaft

71 ..... spring

72 ..... first member

73 ..... second member

74 ..... fixed valve seat of a gas-flow control valve

75 ..... flow control valve

76 ..... control lever

77 ..... control valve

78 ..... first member

79 ..... second member

80 ..... control lever

81 ..... fixed valve seat of a gas-flow control valve

82 ..... flow control valve

83 ..... catalyst for combustion

84 ..... gas supply hole

85 ..... gas diffuser

86 ..... ignition heater

87 ..... lead wire

88 ..... catalyst for ignition confirmation

89 ..... tip end

90 ..... through-hole

91 ..... gas supply hole for an ignition confirmation catalyst

92 ..... catalyst for ignition confirmation

93 ..... catalyst for combustion

94 ..... gas diffuser

95 ..... through hole

96 ..... catalyst for ignition confirmation

97 ..... through hole

98 ..... gas diffuser

99 ..... gas supply hole

100 ..... catalyst for ignition confirmation

101 ..... through hole

102 ..... gas supply hole

CATALYTIC COMBUSTION DEVICE

BACKGROUND OF THE INVENTION

1. Field of the Invention

The present invention relates to a domestic catalytic combustion device using catalytic combustion heat as the heat source.

2. Description of Related Art

Heretofore catalytic combustion devices wherein a fuel, which is a gas at room temperature (hereinafter referred to as "liquefied fuel"), such as hydrogen, methane, propane or butane is burnt on surfaces of a catalyst consisting of a noble metal such as platinum or palladium carried on a support or carrier made of glass fibers, porous metal or ceramics. Such catalytic combustion devices are used in domestic appliances such as radiant heaters or stoves fired with a liquefied petroleum gas (LPG) or town gas, soft soldering irons or hair curlers fired with an LPG, or body warmers fired with benzine.

According to the known devices, it has been customary practice to adjust the rate of supply of fuel by means of a pressure regulator and a nozzle associated therewith, thereby adjusting the amount of combustion and the heating temperature. With this arrangement, the adjustment of the amount of combustion in response to the temperature of a combustion chamber or an object to be heated is difficult to achieve.

The catalytic combustion burner is required to have a small thermal capacity for ignitability. Further, the temperature of the catalyst well depends on the change in the rate of supply of gas. Therefore, it is required that the gas supply to the catalytic combustion burner is controlled in response to the temperature of catalyst. Because of its greater thermal capacity, the heating object cools substantially slower than the catalyst during which time the temperature of the catalyst is lowered below the combustible temperature. The catalyst cannot be ignited again and hence a continuous combustion cannot be achieved. On the other hand, at the ignition and temperature glow stages, the catalyst becomes hot well before the heating element is heated and sometimes it is heated at an undue elevated temperature which would have a negative influence on the service time of the catalyst. In order to overcome the foregoing drawbacks, it is necessary to detect a temperature at a point adjacent to the catalyst.

There have been known hair curlers which comprise a bimetal or an expandable liquid thermostatic element disposed in a heating chamber containing a catalytic combustion burner for detecting temperature and for controlling the rate of gas flow in response to the detected temperature. The known hair curler has a drawback in that both the burner and the thermostatic element are disposed in a curling pipe and hence reduction in diameter of the curling pipe is difficult to achieve.

Gas-fired ovens, gas-fired grills or gas-fired water heaters with a flame combustion burner without using a catalyst are known in which a bimetal or an expandable liquid thermostatic element is disposed in a combustion chamber or heating object for detecting the temperature to thereby adjusting the amount of combustion gas. With this arrangement, the thermostatic element is disposed in the combustion chamber through which the waste gas flows, so that the thermostatic element is susceptible to corrosion. A further disadvantage is that a cooking material or other substance is likely to adhere to the surface of the thermostatic element to thereby alter the set temperature.

SUMMARY OF THE INVENTION

A catalytic combustion device of the present invention comprises a tubular first member supporting thereon a catalyst for supplying a fuel vapor to the catalyst, and a tubular second member disposed in the first member defining therein a passageway for the fuel vapor, said second member being secured at its one end to the first member. The first and second members jointly constitute a thermostatic element for controlling the rate of gas flow by means of the difference in thermal expansion between the first and second members.

DESCRIPTION OF THE PREFERRED EMBODIMENTS

Figure 1:
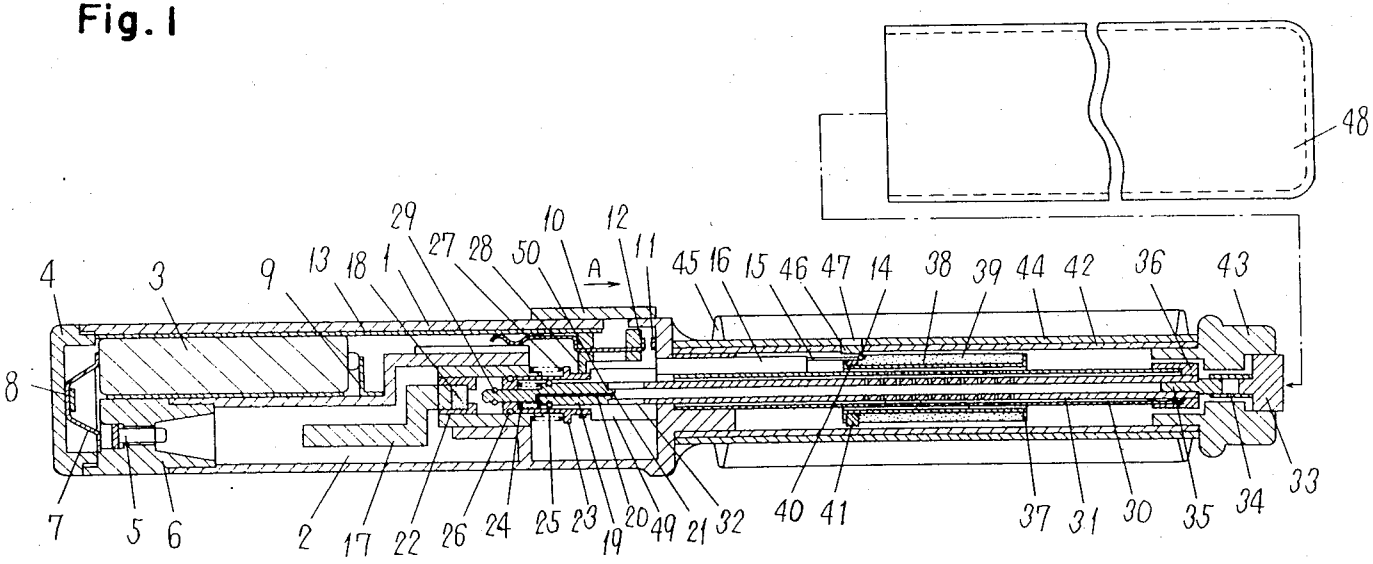
FIG. 1 is a cross-sectional view of a hair curler embodying the present invention.
Figure 2:
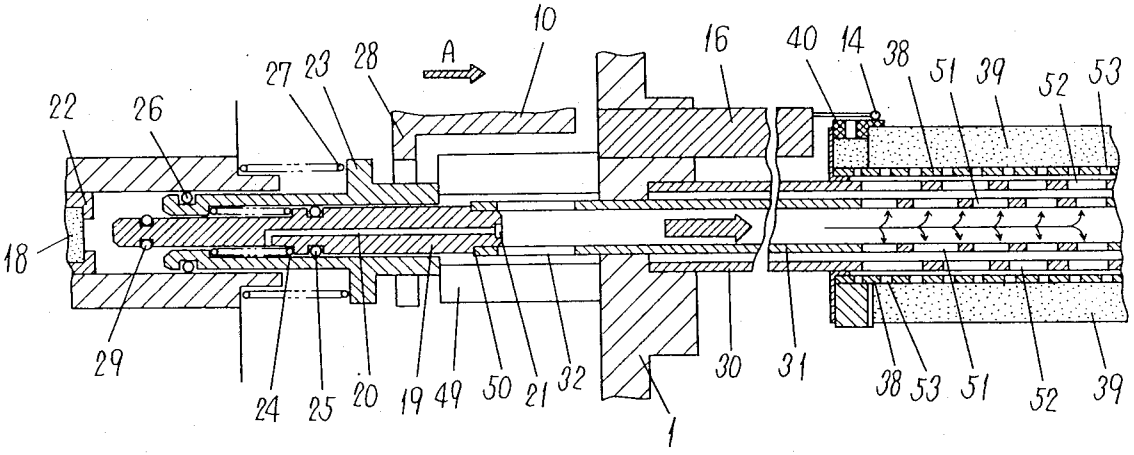
FIG. 2 is an enlarged cross-sectional view of a portion of the hair curler.

The present invention will be described with reference to a catalytic combustion device as applied to a hair curler. As shown in FIGS. 1 and 2, a tank casing 1 constitutes a tank 2 for storing a liquefied fuel gas and houses a cell or battery 3 therein, the tank casing 1 also constituting a grip of the hair curler. A bottom cap 4 is detachably mounted on one end of the casing 1 and includes a gas injecting portion 6 having an injector valve 5, and a cathode or negative terminal 7 attached to the cap 4 by a screw 8, the terminal 7 being engageable with a cathode or negative pole of the battery 3. Designated at 9 is an anode or positive terminal engageable with an anode or positive pole of the battery 3. When a switching button 10 is actuated to turn on a switch, a switching terminal 12 connected to the button 10 is brought into contact with a heater terminal 11, whereupon an ignition heater 14 is electrified through a battery case or cover 13 connected to the negative terminal 7. The numeral 15 denotes a lead wire connected to the ignition heater 14, the wire 15 is covered with an insulation tube 16.

The liquefied fuel gas contained in the tank 2 is fed through a wick 17 to a vaporizing portion 18 for vaporization. The fuel vapor passes through a passageway 20 in a flow control valve 19 and then ejected from a nozzle 21. The vaporizing portion 18 is constituted by a porous material such as a sintered metal or ceramics press-fitted in or clinched with a closure tube 22. Alternatively, the vaporizing portion 18 may comprise an osmotic membrane for vaporizing.

Designated at 23 is a valve disposed coaxially around the valve 19. The valve 23 is normally urged toward the nozzle 21 by means of a coil spring 27. An O-ring 25 is disposed between the valves 19, 23 to provide a seal therebetween, and an O-ring 26 is disposed between the valve 23 and the casing 1 to provide a seal between the valve 23 and the vaporizing portion 18.

The valve 23 is normally urged toward the nozzle 21 by the coil spring 27 as described above, and it is urged toward the vaporizing portion 18 by means of a lever 28 integral with the switching button 10 when the latter is brought into the "off" position. In this instance, an O-ring 29 mounted on the valve 19 is brought into engagement with the valve 23 under the force of a coil spring 24 urging the valve 19 toward the nozzle 21, thereby interrupting the supply of fuel vapor from the vaporizing portion 18 to the nozzle 21.

The reference numeral 30 denotes a tubular first member made of a metal having a large coefficient of thermal expansion, such as aluminum, stainless steel or brass. A tubular second member 31 is made of a material having a small coefficient of thermal expansion, such as an Fe-Ni alloy known an Invar metal, ceramics or glass. The second member 31 is disposed concentrically in the first member 30 so that both members 30, 31 jointly constitute a thermal sensor or thermostatic element. The second member 31 is disposed in alignment with the nozzle 21 and has an air sucking portion 32 provided at its one end adjacent to the nozzle 21 for introducing air into the second member 31. The opposite end of the second member 31 is closed by a sealing screw 35 which is connected to a temperature selector 33 by means of a connector 34. The first member 30 is secured to the tank casing 1 at its one end adjacent to the nozzle 21 and is threaded at the opposite end which is located adjacent to the temperature selector 33, over the second member 31 via a safety member 36 made of a fusible metal.

A perforated gas diffuser tube 38 is disposed around the first member 30 with a spacer or collar 37 interposed therebetween. The gas diffuser tube 38 supports on its peripheral surface a combustion catalyst 39. Disposed on one end of the pilot catalyst 39 adjacent to the ignition heater 14 is an ignition confirmation catalyst 40 supported on a retainer 41 so as to constitute a catalytic burner portion, the ignition confirmation pilot catalyst 40 having been diffused in a high-heat-resistant carrier with an increased density. A heat transfer tube 42 is disposed around the catalytic burner portion and has a discharge hole properly formed therein. The heat transfer tube 42 is made of a high-thermally conductive material and secured at one end to the tank casing 1. The opposite end of the tube 42 is sealed by a burner plug 43. Designated at 44 is a curling element fitted over the heat transfer tube 42 and having a plurality of protruberances or ribs 45. The heat transfer tube 42 has a transparent member 46 disposed in alignment with the ignition confirmation catalyst 40, and the curling element 44 has a window 47 disposed directly above the transparent member 46. With this arrangement, ignition and combustion of the catalyst 40 can visually be confirmed or otherwise observed with utmost ease. A cover or cap 48 is detachably mounted on the curling element 44 and is removed therefrom when the hair curler is to be used for the treatment or setting up of the user's hair.

The hair curler thus constructed operates as follows: The cap 48 is removed from the curling element 44 and then the switching button 10 is slid in the direction of the arrow A to the "on" position whereupon the lever 28 integral with the switching button 10 is moved in the direction of the arrow A to thereby allow the valve 23 to move toward the nozzle 21 under the force of the coil spring 27 until the valve 23 impinges against an abutting rib 49. Since the elastic modulus of the coil spring 24 is smaller than that of the coil spring 27, the flow control valve 19 moves along with the valve 23 in the direction of the arrow A until its shoulder 50 provided adjacent to the nozzle 21 abuts against an end face of the second member 31. This movement causes the O-ring 29 on the valve 19 to disengage from the valve 23 whereupon the fuel gas vaporized at the vaporizing portion 18 flows through the passageway 20 and is ejected from the nozzle 21 into the interior of the second member 31. The ejected fuel gas is then mixed up with a proper amount of air sucked through the air sucking portion 32 into the second member 31. The air sucking portion 32 is arranged such that the density of fuel gas in a fuel-air mixture and hence the quantity of sucked air is rendered nearby equal to a theoretical value which varies depending on the kind of fuel gas to be used, such, for example, as 30.9 times in volumeric ratio for butane and 23.8 times for propane.

The mixture flows through the second member 31 then through a number of apertures 51 in the second member 31 and thence is ejected from a number of apertures 52 in the first member 30. The ejected mixture is diffused through a number of apertures 53 in the gas diffuser tube 38 into the combustion catalyst 39 and the ignition confirmation catalyst 40. Diffusion of the fuel mixture is undertaken substantially at the same time when the switching button 10 is set at its "on" position. Further sliding movement of the switching button 10 in the direction of the arrow A causes the switching terminal 12 to engage the heater terminal 11 whereupon the ignition heater 14 becomes red-hot to ignite the mixture rapidly. Due to arrangement of the apertures 53 in the diffuser tube 38, a greater amount of the mixture is supplied to the ignition confirmation catalyst 40 than the combustion catalyst 39, the ignition confirmation catalyst 40 burns red-hot prior to the combustion catalyst 39. Such ignition or firing of the ignition confirmation catalyst 40 is visually confirmed from the outside through the transparent member 46.

The combustion catalyst 39 starts firing to heat the heat transfer tube 42 and hence the curling element 44 to an elevated temperature at which is ready for use. The temperature of the curling element 44 can be set at the user's desire by the temperature selector 33. Namely, upon rotation of the temperature selector 33, the second member 31 threaded to the first member 30 is axially moved while rotating about its axis, via a train of the connector 34 and the sealing screw 35. The axial movement of the second member 31 causes axial movement of the valve 19 via the shoulder 50 to thereby vary the distance between the O-ring 29 on the valve 19 and the valve 23, i.e. the relative position between the valve 19 and the valve 23. For setting of a higher temperature, such distance is made larger whereas the same distance is shortened for a lower temperature setting. The temperature can be selected only by rotating the temperature selector 33. Since the calorific value of the combustion catalyst 39 varies depending on a temperature thus selected, the temperatures of the heat transfer tube 42 and the curling element 44 also vary in proportion to an angular movement of the temperature selector 33. The temperature selector 33 is disposed in the burner plug 43 mounted on the opposite end of the heat transfer tube 42. It is noted in this regard that since the tank casing 1 and the burner plug 43 are gripped by the user's fingers while in use, the temperature selector 33 must be protected against accidental rotation by the user's fingers tending to change the set temperature. According to the disclosed embodiment of the present invention, the second member 31 of the temperature regulating mechanism is disposed centrally in the curling element 44 with the result that the temperature selector 33 can be mounted in the burner plug 43 which constitutes a gripping portion. With this arrangement, the temperature setting can easily be achieved from the outside of the hair curler and the utility of the latter is improved too.

As described above, the first and the second members 30, 31 have different coefficients of thermal expansion, and more particularly, the first member 30 has a larger coefficient of thermal expansion than that of the second member 31. On being heated the first member 30 expands and increases its length to thereby move the second member 31 toward the burner plug 43 whereupon the valve 19 moves in the same direction under the force of the coil spring 24. During that time, the valve 23 is kept immovable by the abutting rib 49 with the result that the O-ring 29 is brought into sealing engagement with the valve 23 to interrupt the supply of fuel vapor. The mixed gas continuously flowing through the second member 31 cools and prevents any temperature increase of the second member 31. In addition, because of the smallness of the coefficient of thermal expansion of the second member 31, the difference in thermal expansion between the first and second members increases gradually. Thus, fine and sensitive temperature control is effected. Upon interruption of the supply of fuel vapor, the first member 30 cools to restore its original length whereupon the O-ring 29 disengages from the valve 23 with a result that the fuel vapor is supplied again for burning into the second member 31. The first and second members 30, 31 with different coefficients of thermal expansion jointly constitute such a thermostatic element which senses the temperature of the catalyst 39 directly. This direct sensing guarantees to automatically and continuously control the set temperature without interrupting the combustion otherwise caused when the catalyst 39 cools below the combustible temperature during interruption of the supply of fuel gas.

According to the embodiment of the present invention just described above, since the set temperature can be maintained by means of the aforesaid automatic temperature control, the hair curler operates at substantially constant temperature. The hair curler further comprises the safety member 36 to prevent the user from getting burnt or the curler itself from causing a fire when overheated due to accidental combustion of the catalyst 39 caused by some reason. The safety member 36 is made of a fusible metal such as a Pb-Sn alloy, secured to the first member 30, and threaded to the sealing screw 35 threaded into the second member 31. The operating temperature or melting temperature of the safety member 36 can easily be selected depending on the fusible metal or composition of the alloy embodied.

When the first member 30 is overheated due to accidental combustion, the safety member 36 melts to detach the second member 31 whereupon the coil spring 24 which is urging the valve 19 toward the nozzle 21, further extends to urge the valve 19 toward the nozzle 21 until the O-ring 29 engages the valve 23 to interrupt the supply of the fuel vapor.

Figure 3:
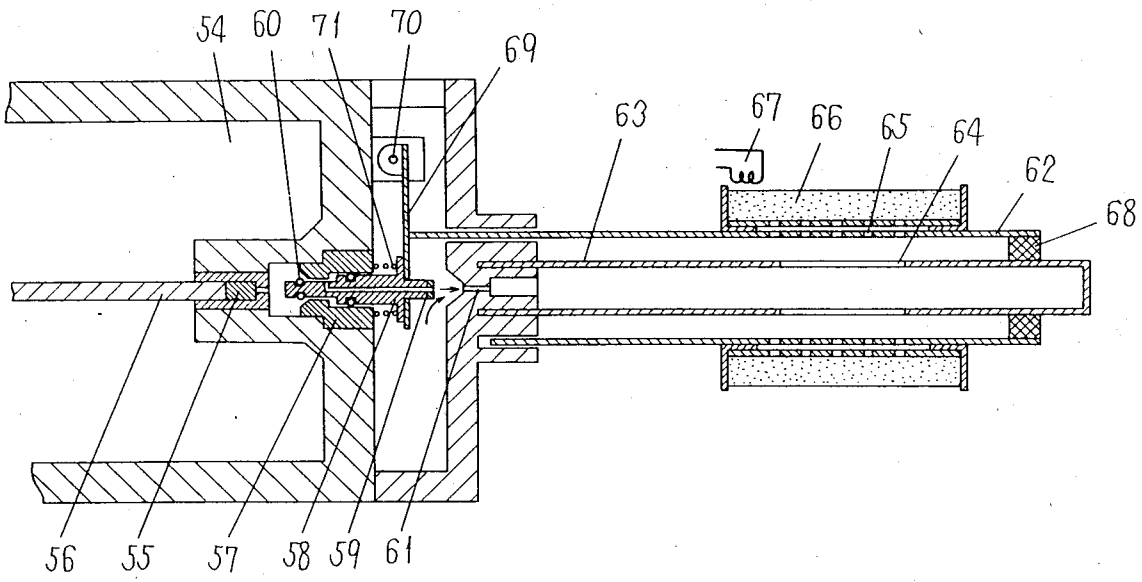
FIGS. 3 through 5 are fragmentary cross-sectional views showing different modifications of thermostatic elements.

Modified catalytic burners of the present invention are described below with reference to FIGS. 3 through 5. In FIG. 3, a tank for a liquefied fuel gas is shown and designated at 54. The number 55 denotes a vaporizer for vaporizing the liquefied fuel under rapid pressure reduction of the fuel in the tank 54. A wick 56 is made of a porous or fibrous material and serves to introduce the liquefied fuel stably into the vaporizer 55, regardless of the posture of the catalytic combustion device.

The fuel is vaporized by the vaporizer 55 and thence flows successively through a passageway in a fixed valve seat 57 and a passageway in a flow control valve 58 and is finally ejected from a nozzle 59. Denoted at 60 is a control valve secured to the flow control valve 58.

The fuel vapor ejected from the nozzle 59 sucks a necessary and sufficient amount of air for combustion, under the ejector effect of an injector 61, as it passes through the injector 61. The fuel vapor is mixed up with air in a tubular second member 63 prior to the arrival at a tubular first member 62, then passes through a plurality of blow holes or slits 64 and is finally supplied through a plurality of gas supply holes 65 to a combustion catalyst 66 where it is oxidized. The fuel vapor may be supplied directly to the combustion catalyst 66. The reference numeral 67 denotes an ignition heater for firing the mixed gas or fuel vapor at the catalyst 66.

The first and second members 62, 63 are secured together by means of a fixing member 68. The first member 62, made of a material having a coefficient of thermal expansion smaller than that of a material constituting the second member 63 so that the first and second members 62, 63 joined by the fixing member 68 constitute a thermostatic element. The first member 62 is connected at one end with a control lever 69 which is pivotably movable about a pivot shaft 70 in response to the movement of the first member 62. The flow control valve 58 is operatively connected to the control lever 69 and hence is axially movable in response to angular movement of the control lever 69 so as to vary a distance between the control valve 60 and the valve seat 57 of the flow control valve 58, thereby controlling the flow rate of the fuel vapor. The flow control valve 58 is urged against the control lever 69 by means of a spring 71.

The catalytic burner thus constructed operates as follows: Since the catalyst 66 is preheated to a combustible temperature by the ignition heater 67, the mixed gas burns as soon as it is supplied through the gas supply holes 65 in the second member 63 to the preheated catalyst 66. Combustion on the catalyst 66 raises the temperature of the first and second members 62, 63. Since the second member 63 has a larger coefficient of thermal expansion than the first member 62, on being heated, it expands in a direction away from the nozzle 58 whereupon the control lever 69 and the flow control valve 58 are urged toward the same direction by means of the spring 71. This movement of the flow control valve 58 narrows or reduces the distance between the control valve 60 and the fixed valve seat 57, thereby reducing the rate of the supply of fuel vapor and hence the final quantity of combustion. Thus, the temperature of the catalyst 66 is maintained constant.

Figure 4:
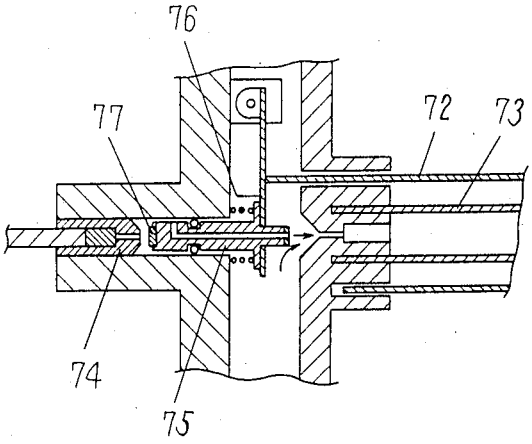

FIG. 4 shows another embodiment wherein a first member 72 is made of a material whose coefficient of thermal expansion is larger than that of a material constituting a second member 73. Due to the first and second members 72, 73 thus arranged, the structure of a fixed valve seat 74 of a flow control valve 75 and the flow control valve 75 are different from the structure of those in the embodiment shown in FIG. 3. In this embodiment, on being heated, the first member 73 urges the control lever 76 downwardly whereupon the flow control valve 75 is lowered to reduce the distance between the control valve 77 and the fixed valve seat 74, thereby controlling the rate of the supply of the fuel vapor. The temperature of the catalyst can thus be maintained constant.

Figure 5:
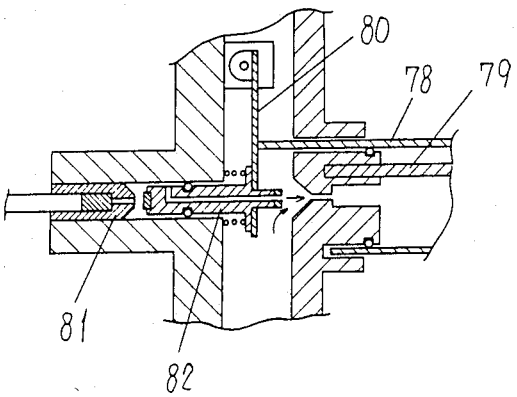

FIG. 5 shows a further embodiment wherein a first member 78, a control lever 80, a fixed valve seat 81 of a flow control valve 82 and the flow control valve 82 itself are the same as those in the embodiment shown in FIG. 4. A second member 79 is however in the form of a rod instead of a tube so that the mixed gas flows along the circumferential surface of the second member 79. Operation of this catalytic burner is the same as the one shown in FIG. 4.

Figure 6:
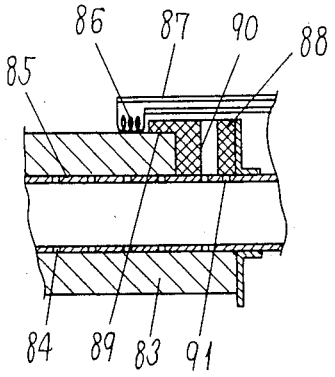
FIGS. 6 through 9 are fragmentary cross-sectional views showing different modifications of ignition confirmation catalysts.

Various modifications of the ignition confirmation catalyst are described below with reference to FIGS. 6 through 9. In FIG. 6, a combustion catalyst 83 is shown for oxidizing a mixture of a fuel vapor and air. The catalyst 83 is supported on the outer peripheral surface of a tubular gas diffuser 85 having a number of gas supply holes 84 and made of a heat-resistant material such as metal or ceramics. An ignition heater 86 comprises a wire made of a noble metal having oxidation catalytic activity such as platinum, platinum-palladium, palladium, or made of a nickel-chromium alloy or stainless steel. Designated at 87 is a lead wire for supplying an electric current to the ignition heater 86. An ignition confirmation catalyst 88 is disposed on or adjacent to the combustion catalyst 83 and has a tip end 89 held in contact with or disposed adjacent to the ignition heater 86. The ignition confirmation catalyst 88 has a through-hole 90 extending in a direction parallel to the flow of the fuel vapor or the fuel-air mixture. The gas diffuser 85 has a plurality of gas supply holes 91 for supplying therethrough the gas to the ignition confirmation catalyst 88.

The above-mentioned arrangement operates as follows: The mixed gas flows through the gas diffuser 85 and then is supplied to the combustion catalyst 83 and the ignition confirmation catalyst 88 respectively through the supply holes 84 and the supply holes 91. Substantially at the same time, the ignition heater 86 is turned on and a portion of the combustion catalyst 83 which engages the ignition heater 86 is heated. When the temperature of the catalyst 83 becomes equal to a combustible temperature of the fuel vapor, catalytic combustion is initiated. Heat generated by the ignition heater 86 while being energized is transferred to the ignition confirmation catalyst 88 through the tip end 89 thereof. Likewise, combustion heat generated by the catalyst 83 is rapidly transferred to the catalyst 88 through the tip end 89 thereof as well as through an interface between the both catalysts 83, 88, thereby initiating catalytic combustion at the ignition confirmation catalyst 88. Due to the smallness of the flow resistance at the through-hole 90 in the catalyst 88, the gas flowing through the catalyst 88 is concentrated into the through-hole 90. The through-hole 90 becomes red-hot so that the ignition of the catalyst 88 is visually confirmed. Likewise, visual confirmation of normal continuous combustion can also be effected by the red-hot through-hole.

The operating temperature of the combustion catalyst preferably is less than 700°-800° C. for durability, whereas the operating temperature of the ignition confirmation catalyst 88 preferably is not less than 700°-800° C. for the purposes described above. In order to provide a temperature difference between the two catalysts, it is necessary to increase the rate of supply of gas through the supply holes 91 in comparison with the gas supply through the supply holes 84. Generally, the rate of supply of gas through the supply holes 91 is greater than that through the supply holes 84 by 5% to 50% per unit area.

The ignition confirmation catalyst 88 must have high enough heat resistance to withstand such a high temperature. The support or carrier preferably involves a catalytic carrier made of ceramics having a high $Al_2O_3$ or $TiO_2$ content, or woolen carrier made of a ceramic wool having a high $Al_2O_3$ or $SiO_2$ content or a glass wool having a high $SiO_2$ content. The ignition confirmation catalyst 88 preferably has a platinum or palladium content which is 1.1 times to 10 times as large as that of the combustion catalyst 83. For prompt confirmation of ignition, the carrier needs to have a small thermal capacity and a high thermal conductivity. A woolen or cloth carrier is preferable in terms of the thermal capacity, and a high thermal conductive material such as metal wire may be added to improve the thermal conductivity of the carrier.

Figure 7:
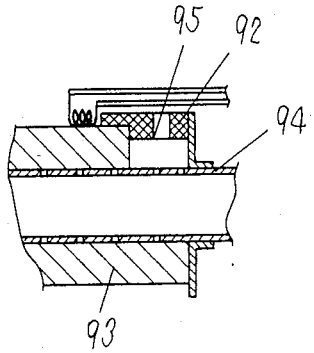

FIG. 7 shows another embodiment wherein an ignition confirmation catalyst 92 is thinner than a combustion catalyst 93. Because of a relatively high density of fuel gas (for propane, 4.02% with a theoretical quantity of air supplied, and for butane 3.13%) and further because of a relatively high rate of combustion, such catalytic combustion is undertaken substantially at a region from which the mixed gas is supplied. As a result, the temperature of the catalyst gradually increases in a direction toward a gas diffuser 94. The same is applied to the ignition confirmation catalyst 92 which has a through-hole 95. The temperature of the catalyst becomes higher in a direction toward the gas diffuser 94. Since the catalyst is relatively thin, the through-hole 95 in the ignition confirmation catalyst 92 can be observed reliably with utmost ease, resulting in a reliable confirmation of ignition and continuous combustion of the catalyst. With the reliable visual observation of a hot portion of the ignition confirmation catalyst 92 thus achieved, it is rendered unnecessary to increase the rate of supply of the mixed gas per unit area as done in the embodiment shown in FIG. 6. With a result that an extended service life of the catalyst 92 can be achieved. The thickness of the catalyst 92 preferably is less than 3 mm.

Figure 8:
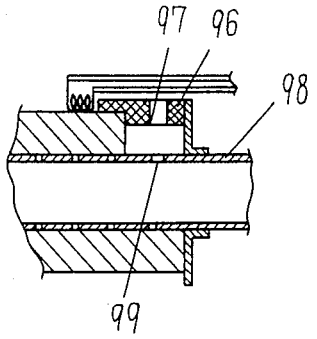

In another embodiment shown in FIG. 8, a through-hole 97 in an ignition confirmation catalyst 96 is held in alignment with a gas supply hole 99 in a gas diffuser 98. With this arrangement, the fuel vapor or the mixed gas supplied from the gas supply hole 99 flows reliably into the through-hole 97 in the catalyst 96 to thereby heat the same to be red-hot. Thus, more reliable confirmation of the ignition and continuous combustion of the catalyst can be effected.

Figure 9:
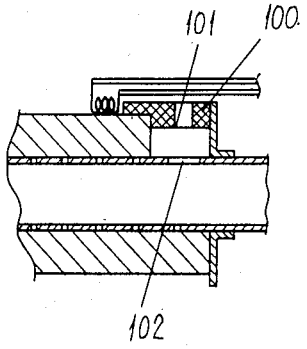

FIG. 9 shows a still further embodiment wherein a through-hole 101 in an ignition confirmation catalyst 100 has a cross-sectional area smaller than that of a gas supply hole 102. With this arrangement, the fuel vapor or the mixed gas flows from the gas supply hole 102 convergently into the through-hole 101 with the result that the through-hole 101 in ignition confirmation becomes red-hot reliably and rapidly and hence reliable confirmation of the ignition and continuous combustion can be effected. This arrangement is further advantageous in that a relatively large assembling tolerance is available, which in turn facilitates the overall manufacture.

Throughout the embodiments shown in FIGS. 6 to 9, only one such through-hole is provided in the respective ignition confirmation catalyst, however, a plurality of such through-holes may be provided. The diameter of the through-hole may vary with respect to the related components but preferably it ranges from 0.1 mm to 3 mm.

We claim:

1. In a catalytic combustion device including a catalyst for oxidation of a fuel vapor and air, and an ignition heater for initiating oxidation on said catalyst, the improvement which comprises a tubular first member carrying thereon said catalyst for supplying the fuel vapor to said catalyst, a tubular second member disposed in said first member defining therein a passageway for the fuel vapor, said second member being secured at its one end to said first member so as to constitute a thermostatic element, and means, cooperating with said first and second members constituting said thermostatic element, for controlling the rate of fuel vapor flow to said catalyst in response to a difference in thermal expansion between said first and second members.

2. A catalytic combustion device according to claim 1 wherein said second member has a coefficient of thermal expansion smaller than that of said first member.

3. A catalytic combustion device according to claim 1 wherein said second member is operatively connected to actuate a gas-flow control valve.

4. A catalytic combustion device according to claim 1 wherein said second member is movable with respect to said first member for adjusting the rate of gas flow.

5. A catalytic combustion device according to claim 1 wherein said first and second members are secured together via a fusible metal.

6. A catalytic combustion device according to claim 1 wherein a gas diffuser tube is disposed over and around said first member with a space therebetween, said gas diffuser tube having a number of apertures and supporting said catalyst on and around its external peripheral surface.

* * * * *